US006482354B1

(12) United States Patent
Wert et al.

(10) Patent No.: US 6,482,354 B1
(45) Date of Patent: Nov. 19, 2002

(54) HIGH-HARDNESS POWDER METALLURGY TOOL STEEL AND ARTICLE MADE THEREFROM

(75) Inventors: David E. Wert, Wyomissing, PA (US); Gregory J. Del Corso, Sinking Spring, PA (US); Harrison A. Garner, Jr., Elverson, PA (US)

(73) Assignee: CRS Holdings, Inc., Wilmington, DE (US)

( * ) Notice: Subject to any disclaimer, the term of this patent is extended or adjusted under 35 U.S.C. 154(b) by 0 days.

(21) Appl. No.: 09/890,039

(22) PCT Filed: Jan. 28, 2000

(86) PCT No.: PCT/US00/02362

§ 371 (c)(1),
(2), (4) Date: Jul. 26, 2001

(87) PCT Pub. No.: WO00/44956

PCT Pub. Date: Aug. 3, 2000

Related U.S. Application Data

(60) Provisional application No. 60/117,820, filed on Jan. 29, 1999.

(51) Int. Cl.[7] ..... C22C 38/22; C22C 38/24; C22C 38/30

(52) U.S. Cl. ..... 420/10; 420/107; 420/111; 420/114; 75/246

(58) Field of Search ..... 148/324; 420/10, 420/114; 75/246

(56) References Cited

U.S. PATENT DOCUMENTS

| | | | |
|---|---|---|---|
| 3,150,444 | A | 9/1964 | Reen |
| 5,403,372 | A | 4/1995 | Uchida |
| 5,969,277 | A | 10/1999 | Adrien et al. |

FOREIGN PATENT DOCUMENTS

| | | |
|---|---|---|
| JP | 01119645 | 5/1989 |
| JP | 06279943 | 10/1994 |
| JP | 09041102 | 2/1997 |

OTHER PUBLICATIONS

J.R. Davis & Associates, Metals Handbook Desk Edition, Second Edition, 1998, ASM International, pp. 347–349.

Metals Handbook Ninth Edition, vol. 3, 1980, American Society for Metals, pp. 422, 425, and 426.

S. Jauregi et al., "Influence of Atmosphere on Sintering of T15 and M2 Steel Powders," Metallurgical Transactions A. Physical Metallurgy and Materials, Science, US, Metallurgical Society of AIME, vol. 23A, No. 2, Feb. 1992, pp. 389–400.

J.M. Torralba et al., "Sinterability study of PM M2 and T15 high speed steels reinforced with tungsten and titanium carbides," Powder Metallurgy, Metals Society, vol. 36, No. 1, Jan. 1993, pp. 55–56.

J.R. Davis & Associates, ASM Specialty Handbook—Tool Materials, 1995, ASM International, pp. 10–14.

*Primary Examiner*—Deborah Yee
(74) *Attorney, Agent, or Firm*—Dann, Dorfman, Herrell and Skillman, P.C.

(57) ABSTRACT

A tool steel alloy having a unique combination of hardness and toughness is disclosed. The alloy contains, in weight percent, about: wt. % C 1.85–2.30, Mn 0.15–1.0, Si 0.15–1.0, P 0.030 max., S 0–0.30, Cr 3.7–5.0, Ni+Cu 0.75 max., Mo 1.0 max., Co 6–12, W 12.0–13.5, V 4.5–7.5. The balance is essentially iron and usual impurities. The elements C, Cr, Mo, W, and V are balanced in this alloy such that $-0.05 \leqq \Delta C \leqq -0.42$ where $\Delta C = ((0.033W)+(0.063Mo)+(0.06Cr)+(0.2V))-C$. A powder metallurgy tool steel article made from consolidated alloy powder having the aforesaid weight percent composition provides a Rockwell C hardness of at least about 69.5 when heat treated.

30 Claims, No Drawings

HIGH-HARDNESS POWDER METALLURGY TOOL STEEL AND ARTICLE MADE THEREFROM

This application claims the benefit of priority of U.S. Provisional Application No. 60/117,820, filed Jan. 29, 1999.

FIELD OF THE INVENTION

This invention relates to tool steel alloys, and in particular, to a high speed tool steel alloy and a powder metallurgy article made therefrom that has a unique combination of hardness and toughness.

BACKGROUND OF THE INVENTION

AISI Type T15 alloy is a known tungsten high speed steel alloy. The Type T15 alloy is considered to be among the premium high speed tool steel grades because it has a combination of hardness and wear resistance that is superior to other high speed tool steel alloys such as Types M2 and M4. Type T15 alloy provides a hardness of about 66 to 67 HRC at room temperature. A higher carbon version of Type T15 alloy that is capable of providing a room temperature hardness of 67 to 68 HRC has been sold in the U.S. However, a demand has arisen in the tooling industry for a high speed tool steel alloy that provides greater combined levels of hardness, including elevated temperature hardness, and wear resistance than the known grades of high speed steel alloys, such as Type T15.

Currently there are essentially two types of materials that are available for the more demanding tooling applications such as metal-cutting tools and gear hobs: conventional high speed tool steels and cemented carbide materials. The known high speed steel alloys, even when produced by powder metallurgy techniques, leave something to be desired for extended tooling runs because tools manufactured from those materials lack sufficient wear resistance, room temperature hardness, and hot hardness. There is presently a trend in industry toward use of dry machining as opposed to the use of cutting fluids because of the potential environmental hazard associated with conventional cutting fluids. Metal cutting tools are likely to be subjected to significantly higher operating temperatures when used in dry machining operations. Most of the known high speed steel alloys are not suitable for use in dry cutting operations because their wear resistance and hardness degrades very rapidly under the extreme temperature conditions.

To avoid the limitations of the known high speed tool steels, one approach has been to produce cutting tools with a very hard surface coating to improve the service life of these cutting tools. Such a coating is typically applied by either physical vapor deposition (PVD) or chemical vapor deposition (CVD). Such coatings are typically harder than about HRC 70, which is much harder than the base tool steel. It would be advantageous to provide a tool steel alloy having increased hardness to back up the very high hardness coating.

Because of the disadvantages associated with the known high speed steel alloys as outlined above, cemented carbide materials have become very attractive for making cutting tools. Cemented carbide materials provide very high hardness, both at room and elevated temperatures, and very good wear resistance. Although cemented carbide tooling materials provide excellent hardness and wear resistance, they have several disadvantages. For example, carbide tooling is very expensive to produce, not only because of the cost of making the carbide blanks, but also because of the extra cost of forming the cutting tools from those blanks. In addition, carbide tools have very low toughness and special care must be taken to prevent fracture during service. Also, extremely rigid machines must be used with carbide tooling, and therefore, a large portion of existing cutting machines cannot be safely run with carbide tooling.

SUMMARY OF THE INVENTION

The alloy according to the present invention, and a consolidated powder metallurgy article formed therefrom, resolve to a large degree several of the problems associated with the known high speed tool steels and cemented carbide materials. In general, the invention provides a high hardness, high speed tool steel alloy having a unique combination of hardness, hot hardness, and toughness. The broad, intermediate, and preferred weight percent compositions of the alloy according to this invention are set forth in Table 1 below.

TABLE 1

| Elmt. | Broad | Intermediate | Preferred |
|---|---|---|---|
| C | 1.85–2.30 | 1.90–2.20 | 1.90–2.20 |
| Mn | 0.15–1.0 | 0.15–0.90 | 0.15–0.90 |
| Si | 0.15–1.0 | 0.50–0.80 | 0.55–0.75 |
| P | 0.030 max. | 0.030 max. | 0.030 max. |
| S | 0–0.30 | 0–0.30 | 0–0.30 |
| Cr | 3.7–5.0 | 4.0–5.0 | 4.25–5.00 |
| Ni + Cu | 0.75 max. | 0.50 max. | 0.50 max. |
| Mo | 1.0 max. | 1.0 max. | 1.0 max. |
| Co | 6–12 | 7–11 | 7.5–10.5 |
| W | 12.0–13.5 | 12.25–13.5 | 12.5–13.5 |
| V | 4.5–7.5 | 5.0–7.0 | 5.0–6.5 |

The balance of the alloy is essentially iron and the usual impurities found in commercial grades of high speed tool steels intended for similar types of service. The carbon content of the alloy according to this invention is controlled such that the parameter $\Delta C$ is about −0.05 to −0.42, better yet about −0.10 to −0.35, and preferably about −0.15 to −0.25. $\Delta C$ is calculated as follows.

$$\Delta C=((0.033W)+(0.063Mo)+(0.06Cr)+(0.2V))-C$$

where ((0.033W)+(0.063Mo)+(0.06Cr)+(0.2V)) is the carbon balance of the alloy, C is the actual carbon content of the alloy, and W, Mo, Cr, V, and C are given in weight percent.

Here and throughout this application, the term "percent" or the symbol "%" means percent by weight unless otherwise indicated.

DETAILED DESCRIPTION

At least about 1.85% carbon is present in this alloy to benefit the high hardness provided by the alloy in the hardened and tempered condition. Carbon combines with the carbide-forming elements in this alloy to produce carbides that contribute to the excellent wear-resistance provided by the alloy. The alloy preferably contains at least about 1.90% carbon. Too much carbon adversely affects the toughness provided by this alloy, and at very high levels, can adversely affect the attainable hardness of the alloy. Therefore, carbon is restricted to not more than about 2.30% and preferably to not more than about 2.20% in this alloy. Because carbon is depleted when carbides are formed in the alloy, the amount of carbon is controlled so that there is sufficient carbon to permit the attainment of the desired hardness provided by the alloy as well as to permit the formation of an adequate volume of hard carbide particles to provide the desired wear resistance. To that end we use the factor ΔC described above whereby the amount of carbon present in the alloy can be controlled to provide the unique combination of properties that are characteristic of this alloy.

This alloy contains at least about 0.15% manganese to benefit the hardenability of the alloy. In the resulfurized embodiment of the alloy according to this invention, manganese combines with sulfur to form manganese-rich sulfides that are highly beneficial to the machinability of the alloy. Too much manganese causes brittleness in this alloy. Therefore, manganese is limited to not more than about 1.0% and preferably to not more than about 0.90%.

At least about 0.15%, better yet at least about 0.50%, and preferably at least about 0.55% silicon is present in this alloy to benefit the hardenability of the alloy and its hardness response. Silicon also contributes to the fluidity of the alloy in the molten state which facilitates the atomization of the alloy for powder metallurgy applications. Too much silicon adversely affects the good toughness provided by this alloy. Therefore, the amount of silicon is restricted to not more than about 1.0%, better yet to not more than about 0.80%, preferably to not more than about 0.75%.

This alloy may contain up to about 0.30% sulfur to form manganese-rich sulfides which benefit the machinability of the alloy as described above. At least about 0.06% sulfur has been found to effective for that purpose. In order to form a sufficient quantity of sulfides to benefit the machinability property, the amounts of manganese and sulfur present in the alloy are selected to provide a Mn-to-S ratio (Mn:S) of about 2:1 to 4:1, and preferably about 2.5:1 to 3.5:1. Sulfur adversely affects the toughness provided by this alloy and, therefore, it is restricted to not more than about 0.30% in the enhanced machinability embodiments of this alloy. Where enhanced machinability is not needed, sulfur should be kept as low as possible. Therefore, in a non-resulfurized embodiment of this alloy, sulfur is restricted to not more than about 0.06%, better yet to not more than about 0.030%, and preferably to not more than about 0.020%.

At least about 3.7% chromium is present to benefit the hardenability provided by this alloy. To that end the alloy preferably contains at least about 4.0%, and better yet, at least about 4.25% chromium. Chromium combines with available carbon to form chromium carbides. In doing so it depletes the alloy of carbon. Such carbon depletion tends to increase the value of ΔC such that the hardness and toughness provided by the alloy are adversely affected. Therefore, chromium is restricted to not more than about 5.0% in this alloy.

Cobalt is present in this alloy because it benefits both the room temperature hardness and the hot hardness provided by the alloy. For that purpose, the alloy contains at least about 6%, better yet, at least about 7%. and, preferably, at least about 7.5% cobalt. Too much cobalt can adversely affect the good toughness provided by this alloy. Therefore, cobalt is restricted to not more than about 12%, better yet to not more than about 11%, and preferably to not more than about 10.5% in this alloy.

This alloy contains at least about 12.0% tungsten to benefit the secondary hardness, wear resistance, and the hot hardness provided by the alloy. If the amount of tungsten is too low, the value of ΔC becomes too negative which adversely affects the hardness and toughness provided by the alloy. Accordingly, the alloy preferably contains at least about 12.25%, and better yet, at least about 12.5% tungsten. When too much tungsten is present in the alloy, the value of ΔC becomes too positive which adversely affects the hardness capability of the alloy. Therefore, tungsten is restricted to not more than about 13.5% in this alloy.

Vanadium contributes to the temper resistance and the secondary hardening response that are characteristic of this alloy. Vanadium combines with available carbon to form vanadium carbides which contribute to the good wear resistance provided by this alloy. The vanadium carbides also help control the grain size of the alloy during the austenitization heat treatment by pinning the grain boundaries. For these reasons, at least about 4.5% vanadium is present in this alloy. We have also found that when at least about 5.0% vanadium is present and ΔC is maintained within the aforesaid ranges, the alloy provides unexpectedly improved toughness at the elevated hardness levels that are characteristic of the alloy. Too much vanadium adversely affects the hardness and toughness provided by this alloy. More specifically, excessive vanadium can cause brittleness in this alloy. Also, if vanadium is not properly balanced with carbon in this alloy, the hardness of the alloy will be adversely affected if there is insufficient carbon to combine with vanadium. Therefore, vanadium is restricted to not more than about 7.5%, better yet, to not more than about 7.0%, and preferably, to not more than about 6.5%.

A small amount of molybdenum may be present in this alloy in substitution for some of the tungsten. Preferably, molybdenum is restricted to not more than about 1.0% because too much causes ΔC to become more positive, which adversely affects the high hardness provided by the alloy.

The balance of the alloy is iron except for the usual small amounts of impurities that are present in commercial grades of high speed tool steel alloys intended for similar service or use. More specifically, nickel and copper are restricted in this alloy to minimize retained austenite in the alloy after high temperature austenitizing heat treatment. Although up to 0.75% nickel or up to 0.75% Cu can be present in this alloy, when both are present, the combined amount of nickel and copper is restricted to not more than about 0.75%. Preferably, not more than about 0.50% nickel-plus-copper is present in this alloy. Up to about 0.1% magnesium and up to about 0.1% titanium can be present in this alloy. In addition, the alloy may pick up nitrogen when it is atomized with nitrogen gas. However, it is expected that no more than about 0.12%, preferably not more than about 0.08% nitrogen is present in nitrogen-atomized metal powder made from this alloy. Phosphorus is restricted to not more than about 0.030%.

This alloy can be made by any conventional process known for making high speed tool steels. Preferably, the alloy is produced by powder metallurgy techniques. For example, a heat is melted and atomized, preferably with nitrogen gas to form a metal powder. The metal powder is screened to the desired mesh size, blended, and consolidated to a substantially fully dense billet or other shape. Consolidation is carried out by any known process such as hot isostatic pressing, rapid isostatic pressing, or simultaneous compaction and reduction. The resulting compact is then subjected to further mechanical working as by press forging, rotary forging, or rolling.

EXAMPLES

In order to demonstrate the unique combination of properties provided by the alloy according to this invention, 11 experimental heats were prepared. The weight percent compositions of each heat are shown in Table 2 below.

TABLE 2

| El. | Ex. 1 | Ex. 2 | Ex. 3 | Ex. 4 | Ex. 5 | Ex. 6 | Ht. A | Ht. B | Ht. C | Ht. D | Ht. E |
|---|---|---|---|---|---|---|---|---|---|---|---|
| C | 1.96 | 2.11 | 1.95 | 2.18 | 2.18 | 2.26 | 1.85 | 2.12 | 1.93 | 2.13 | 2.31 |
| Mn | 0.60 | 0.65 | 0.61 | 0.62 | 0.63 | 0.62 | 0.60 | 0.65 | 0.60 | 0.60 | 0.60 |
| Si | 0.65 | 0.64 | 0.67 | 0.66 | 0.65 | 0.65 | 0.63 | 0.63 | 0.64 | 0.64 | 0.65 |
| P | 0.008 | 0.006 | 0.008 | 0.008 | 0.007 | 0.006 | 0.010 | 0.005 | 0.010 | 0.010 | 0.010 |
| S | 0.24 | 0.23 | 0.23 | 0.24 | 0.25 | 0.24 | 0.23 | 0.24 | 0.24 | 0.24 | 0.24 |
| Cr | 4.74 | 4.80 | 4.77 | 4.81 | 4.87 | 4.89 | 4.69 | 4.87 | 4.74 | 4.73 | 4.81 |
| Ni | 0.26 | 0.20 | 0.24 | 0.21 | 0.20 | 0.20 | 0.27 | 0.20 | 0.26 | 0.25 | 0.25 |
| Mo | 0.19 | 0.22 | 0.20 | 0.22 | 0.22 | 0.22 | 0.20 | 0.24 | 0.20 | 0.20 | 0.20 |
| Cu | 0.06 | 0.06 | 0.06 | 0.06 | 0.06 | 0.06 | 0.06 | 0.07 | 0.06 | 0.06 | 0.07 |
| Co | 7.54 | 10.12 | 10.10 | 7.62 | 10.15 | 10.14 | 4.99 | 5.10 | 5.00 | 4.98 | 5.04 |
| W | 13.18 | 13.02 | 13.32 | 12.99 | 12.87 | 12.95 | 12.87 | 12.78 | 12.82 | 12.97 | 13.17 |
| V | 4.95 | 6.15 | 5.13 | 5.19 | 5.29 | 5.76 | 5.02 | 6.09 | 5.04 | 4.97 | 5.08 |
| N | 0.069 | 0.080 | 0.082 | 0.072 | 0.075 | 0.083 | 0.07 | 0.089 | 0.08 | 0.075 | 0.07 |
| ΔC | −0.24 | −0.15 | −0.19 | −0.41 | −0.39 | −0.37 | −0.13 | −0.17 | −0.20 | −0.41 | −0.56 |

The balance in each case is iron and the usual impurities.

Examples 1 to 6 represent alloys within the scope of the present invention and Heats A to E are comparative alloys. Nominal 300 lb. (136 kg) heats were induction melted under a partial pressure of nitrogen gas and then atomized with nitrogen gas. The resulting metal powder of each heat was screened to −40 mesh, blended, and then filled into an 8 in. round×23 in. long (20.3 cm×58.4 cm) mild steel can. The cans were vacuum outgassed at 400° F. (703° C.) and then hot isostatically pressed (HIP'd) at 15 ksi (103.4 MPa) for 4–5 hours at a temperature of 2050° F. (1121° C.). The as-HIP'd cans were forged to 5½ in. (14 cm) double octagon billets from a forging temperature of 2100° F. (1149° C.). The double-octagonal billets were vermiculite cooled, stressed relieved at 1400° F. (760° C.) for 6 hours, and then cooled in air. The stress-relieved billets were rotary forged to 4 in. (10.2 cm) round bars from a forging temperature of 2100° F. (1149° C.). The as-forged bars were stress relieved at 1400° F. (760° C.) for 4 hours and then cooled in air. The bars were then further annealed at 1616° F. (880° C.) for 8 hours, cooled at 18° F. /hour (10° C. /hour) to 1202° F. (650° C.), and then furnace cooled.

Standard size cube specimens for Rockwell hardness testing were cut from the annealed bar of each heat. The cube samples were preheated for 5 minutes in salt at 1600° F. (871° C.), austenitized in salt at 2250° F. (1232° C.) for 3 minutes, and then quenched in oil. One set of cubes was tempered at 1000° F. (538° C.) for 2 hours and another set of cubes was tempered at 1025° F. (552° C.) for 2 hours. After tempering all cubes were cold treated at −100° F. (−73.3° C.) for 1 hour and then warmed in air to room temperature. The first set of cubes was then tempered at 1000° F. (538° C.) for 2 hours+2 hours and the second set of the cubes was tempered at 1025° F. (552° C.) for 2 hours+2 hours. The 2250° F. (1232° C.) austenitization temperature was selected to provide maximum solutioning of the alloy while still being a commercially feasible process. The cold treating and triple tempering are used to minimize the amount of any austenite retained in the alloy after austenitization. The 1000° F. (538° C.) tempering temperature was selected to provide maximum hardness in this alloy, whereas the 1025° F. (552° C.) tempering temperature was selected to provide better toughness in the alloy, although at a slightly lower hardness level.

Set forth in Table 3 below are the results of room temperature hardness testing on the as-tempered samples from each heat. The results are given in Rockwell C-scale (HRC) and represent the average of 5 readings taken on each sample.

TABLE 3

| Temper Temp. | Ex. 1 | Ex. 2 | Ex. 3 | Ex. 4 | Ex. 5 | Ex. 6 | Ht. A | Ht. B | Ht. C | Ht. D | Ht. E |
|---|---|---|---|---|---|---|---|---|---|---|---|
| 1000° F. (538° C.) | 69.5 | 69.5 | 70.0 | 69.5 | 70.0 | 70.5 | 68.0 | 69.0 | 69.0 | 68.5 | 67.5 |
| 1025° F. (552° C.) | 69.5 | 69.5 | 69.5 | 69.5 | 70.0 | 70.0 | 68.5 | 69.0 | 69.0 | 68.5 | 68.5 |

Test samples measuring 1in.×2in.×3in. (2.5 cm×5.1 cm×7.6 cm) were cut from the annealed bar of each heat for hot hardness testing. These samples were hardened and tempered utilizing the same heat treatment as used for the room temperature hardness test samples. However, the specimens for this test were tempered only at 1025° F. (552° C.). Set forth in Table 4 below are the results of the hot hardness testing of each of the samples. The hardness values were measured while the specimen was maintained at a temperature of 1000° F. (538° C.). Brinell hardness testing was used for this test and the Brinell hardness values were converted to HRC. The results are given in Rockwell C-scale (HRC) and represent the average of 2 readings taken on each sample.

TABLE 4

| | Ex. 1 | Ex. 2 | Ex. 3 | Ex. 4 | Ex. 5 | Ex. 6 | Ht. A | Ht. B | Ht. C | Ht. D | Ht. E |
|---|---|---|---|---|---|---|---|---|---|---|---|
| HRC | 61.0 | 63.0 | 61.0 | 60.0 | 62.0 | 62.5 | 58.0 | 58.0 | 62.5 | 62.0 | 62.0 |

To be useful as a high speed tooling material for the more-demanding requirements of the machine tool industry, a high speed tool steel alloy should provide a hardness of at least about 70 HRC. For practical purposes a hardness of bout 69.5 HRC is considered acceptable when taking into account the expected variation in test blocks and the accuracy of the known testing machines at the desired hardness level. The data in Table 3 clearly show that Examples 1–6 of the alloy according to the present invention provide the desired level of room temperature hardness at each tempering temperature whereas none of Heats A–E was able to achieve the desired level of hardness. The data in Table 4 show that the examples of the alloy according to this invention consistently provide a hot hardness of greater than 60 HRC, whereas some of the comparative heats did not.

Another important aspect of the alloy according to the present invention is that it provides acceptable toughness at the significantly higher hardness that is characteristic of the alloy. To demonstrate the good toughness provided by this alloy, Izod testing was performed on standard, unnotched Izod test samples cut from the bars of each heat. The test samples were cut with a longitudinal orientation. The Izod test samples were hardened and tempered in the same manner as the room temperature hardness specimens described above. The hardness of each test sample was also determined Shown in Tables 5A and 5B are the results of room temperature testing including the Rockwell hardness (HRC) of each test specimen (HRC) and the Izod impact toughness in ft.-lbs (J). Table 5A shows the results for the specimens tempered at 1000° F. (538° C.) and Table 5B shows the results for the specimens tempered at 1025° F. (552° C.). Triplicate specimens of each composition were tested and the individual impact toughness results are reported together with the average thereof. The Izod test can have a significant variance between individual readings. Therefore, it is appropriate to consider average values when comparing results.

TABLE 5A

| | | Impact Toughness | |
|---|---|---|---|
| Ex./Ht. | HRC | Individual | Avg. |
| 1 | 69.5 | 12.0, 11.0, 11.5<br>(16.3, 14.9, 15.6) | 11.5<br>(15.6) |
| 2 | 69.5 | 7.5, 5.5, 6.5<br>(10.2, 7.5, 8.8) | 6.5<br>(8.8) |
| 3 | 69.5 | 4.0, 1.0, 7.5<br>(5.4, 1.4, 10.2) | 4.2<br>(5.7) |
| 4 | 69.5 | 3.0, 6.0, 7.0<br>(4.1, 8.1, 9.5) | 5.3<br>(7.2) |
| 5 | 70.0 | 6.5, 8.0, 5.5<br>(8.8, 10.8, 7.5) | 6.7<br>(9.1) |
| 6 | 70.0 | 6.0, 7.0, 4.0<br>(8.1, 9.5, 5.4) | 5.7<br>(7.7) |
| A | 68.5 | 19.0, 20.0, 13.5<br>(25.7, 27.1, 18.3) | 17.5<br>(23.7) |
| B | 69.0 | 7.5, 16.5, 17.0<br>(10.2, 22.4, 23.0) | 13.7<br>18.6) |
| C | 69.0 | 7.5, 14.5, 8.5<br>(10.2, 19.7, 11.5) | 10.2<br>(13.8) |

TABLE 5A-continued

| | | Impact Toughness | |
|---|---|---|---|
| Ex./Ht. | HRC | Individual | Avg. |
| D | 68.0 | 7.0, 8.0, 8.0<br>(9.5, 10.8, 10.8) | 7.7<br>(10.4) |
| E | 67.5 | 7.0, 3.5, 7.0<br>(9.5, 4.7, 9.5) | 5.8<br>(7.8) |

TABLE 5B

| | | Impact Toughness | |
|---|---|---|---|
| Ex./Ht. | HRC | Individual | Avg. |
| 1 | 69.5 | 9.0, 8.0, 8.0<br>(12.2, 10.8, 10.8) | 8.3<br>(11.3) |
| 2 | 69.5 | 13.0, 8.0, 10.5<br>(17.6, 10.8, 14.2) | 10.5<br>(14.2) |
| 3 | 69.5 | 5.0, 6.0, 11.5<br>(6.8, 8.1, 15.6) | 7.5<br>(10.2) |
| 4 | 69.5 | 8.0, 8.0, 13.5<br>(10.8, 10.8, 18.3) | 9.8<br>(13.3) |
| 5 | 70.0 | 5.0, 5.0, 5.5<br>(6.8, 6.8, 7.5) | 5.2<br>(7.1) |
| 6 | 70.0 | 6.5, 4.0, 4.5<br>(8.8, 5.4, 6.1) | 5.0<br>(6.8) |
| A | 68.5 | 16.5, 16.0, 20.0<br>(22.4, 21.7, 27.1) | 17.5<br>(23.7) |
| B | 69.0 | 11.5, 12.0, 12.0<br>(15.6, 16.3, 16.3) | 11.8<br>(16) |
| C | 69.0 | 9.5, 4.0, 6.5<br>(12.9, 5.4, 8.8) | 6.7<br>(9.1) |
| D | 68.0 | 8.0, 5.5, 6.0<br>(10.8, 7.5, 8.1) | 6.5<br>(8.8) |
| E | 67.5 | 4.0, 6.0, 4.0<br>(5.4, 8.1, 5.4) | 4.7<br>(6.4) |

Acceptable toughness for a high hardness, high speed tool steel alloy, such as that according to the present invention, is indicated by an Izod impact toughness value of at least 6 ft.-lbs (8.1 J) for material tempered at 1000° F. (538° C.) or by a value of at least 7 ft.-lbs. (9.5 J) for material tempered at 1025° F. (552° C.). Although those threshold values are somewhat lower than the impact toughness levels provided by the known high speed tool steel alloys, it is important to note that the known alloys do not provide the very high hardness provided by the alloy of this invention. Furthermore, the threshold values are significantly better than the toughness provided by cemented carbide tool materials which do provide very high hardness levels. It is also important to note that the toughness of a high speed tool steel alloy after tempering at 1025° F. (552° C.) is of greater significance because from the commercial perspective, most tool fabricators use a tempering temperature of 1025° F. (552° C.) or higher in order to obtain better toughness in the tools and to obtain a higher working temperature range for the tools.

When considered as a whole, the data in Tables 5A and 5B show that examples of the alloy according to the present invention provide a superior combination of hardness and toughness compared to the heats of the other alloy compositions. The data in Table 5A show that Examples 1, 2, and 5 meet or exceed the 6 ft.-lb. (8.1 J) minimum Izod impact toughness criterion at a significantly higher hardness level than any of comparative Heats A to D. Since high hardness is a primary requirement of high speed tool materials, Examples 3, 4, and 6 would be acceptable compositions for tooling applications where toughness is not a significant concern. Heat E does not meet either the minimum hardness criterion or the minimum toughness criterion. The data in Table 5B show that Examples 1, 2, 3, and 4 meet or exceed the 7 ft.-lb. (9.5 J) minimum Izod impact toughness criterion at a significantly higher hardness level than either of comparative Heats A or B. Heats C, D, and E do not meet either the minimum hardness criterion or the minimum toughness criterion.

The terms and expressions which have been employed herein are used as terms of description, not of limitation. There is no intention in the use of such terms and expressions of excluding any equivalents of the elements or features shown and described or portions thereof. However, it is recognized that various modifications are possible within the scope of the invention claimed.

What is claimed is:

1. A tool steel alloy having a unique combination of hardness and toughness, said alloy consisting essentially of, in weight percent, about:

| | wt. % |
|---|---|
| C | 1.85–2.30 |
| Mn | 0.15–1.0 |
| Si | 0.15–1.0 |
| P | 0.030 max. |
| S | 0–0.30 |
| Cr | 3.7–5.0 |
| Ni + Cu | 0.75 max. |
| Mo | 1.0 max. |
| Co | 6–12 |
| W | 12.0–13.5 |
| V | 4.5–7.5 |

and the balance is essentially iron and usual impurities, wherein the elements C, Cr, Mo, W, and V are balanced such that $$-0.05 \leqq \Delta C \leqq -0.42$$

where $$\Delta C = ((0.033W) + (0.063Mo) + (0.06Cr) + (0.2V)) - C.$$

2. The tool steel alloy set forth in claim 1 which contains at least about 1.90% carbon.

3. The tool steel alloy set forth in claim 1 which contains at least about 4.0% chromium.

4. The tool steel alloy set forth in claim 1 which contains at least about 7% cobalt.

5. The tool steel alloy set forth in claim 1 which contains at least about 12.25% tungsten.

6. The tool steel alloy set forth in claim 1 which contains at least about 5.0% vanadium.

7. The tool steel alloy set forth in claim 1 which contains not more than about 0.06% sulfur.

8. A tool steel alloy having a unique combination of hardness and toughness, said alloy consisting essentially of, in weight percent, about:

| | wt. % |
|---|---|
| C | 1.90–2.20 |
| Mn | 0.15–0.90 |
| Si | 0.50–0.80 |
| P | 0.030 max. |
| S | 0–0.30 |
| Cr | 4.0–5.0 |
| Ni + Cu | 0.50 max. |
| Mo | 1.0 max. |
| Co | 7–11 |
| W | 12.25–13.5 |
| V | 5.0–7.0 |

and the balance is essentially iron and usual impurities, wherein the elements C, Cr, Mo, W, and V are balanced such that $$-0.10 \leqq \Delta C \leqq -0.35$$

where $$\Delta C = ((0.033W) + (0.063Mo) + (0.06Cr) + (0.2V)) - C.$$

9. The tool steel alloy set forth in claim 8 which contains at least about 4.25% chromium.

10. The tool steel alloy set forth in claim 8 which contains at least about 7.5% cobalt.

11. The tool steel alloy set forth in claim 8 which contains at least about 12.5% tungsten.

12. The tool steel alloy set forth in claim 8 wherein $-0.15 \leqq \Delta C \leqq -0.25$.

13. The tool steel alloy set forth in claim 8 which contains not more than about 0.06% sulfur.

14. A tool steel alloy having a unique combination of hardness and toughness, said alloy consisting essentially of, in weight percent, about:

| | wt. % |
|---|---|
| C | 1.90–2.20 |
| Mn | 0.15–0.90 |
| Si | 0.55–0.75 |
| P | 0.030 max. |
| S | 0–0.30 |
| Cr | 4.25–5.00 |
| Ni + Cu | 0.50 max. |
| Mo | 1.0 max. |
| Co | 7.5–10.5 |
| W | 12.5–13.5 |
| V | 5.0–6.5 |

and the balance is essentially iron and usual impurities, wherein the elements C, Cr, Mo, W, and V are balanced such that $$-0.15 \leqq \Delta C \leqq -0.25$$

where $$\Delta C = ((0.033W) + (0.063Mo) + (0.06Cr) + (0.2V)) - C.$$

15. The tool steel alloy set forth in claim 14 which contains not more than about 0.06% sulfur.

16. A powder metallurgy tool steel article having a unique combination of hardness and toughness said article being made from consolidated alloy powder having the following weight percent composition:

| | wt. % |
|---|---|
| C | 1.85–2.30 |
| Mn | 0.15–1.0 |
| Si | 0.15–1.0 |
| P | 0.030 max. |
| S | 0–0.30 |
| Cr | 3.7–5.0 |
| Ni + Cu | 0.75 max. |
| Mo | 1.0 max. |
| Co | 6–12 |
| W | 12.0–13.5 |
| V | 4.5–7.5 |

and the balance essentially iron and usual impurities, wherein the elements C, Cr, Mo, W, and V are balanced such that $$-0.05 \leqq \Delta C \leqq -0.42$$

where $$\Delta C = ((0.033W) + (0.063Mo) + (0.06Cr) + (0.2V)) - C$$

said article, when heat treated, provides a Rockwell C hardness of at least about 69.5.

17. A tool steel article as set forth in claim 16 wherein the alloy powder contains about 1.90–2.20% carbon.

18. A tool steel article as set forth in claim 16 wherein the alloy powder contains about 4.0–5.0% chromium.

19. A tool steel article as set forth in claim 16 wherein the alloy powder contains about 7–11% cobalt.

20. A tool steel article as set forth in claim 16 wherein the alloy powder contains about 12.25–13.5% tungsten.

21. A tool steel article as set forth in claim 16 wherein the alloy powder contains about 5.0–7.0% vanadium.

22. A tool steel article as set forth in claim 16 wherein the alloy powder contains not more than about 0.06% sulfur.

23. A powder metallurgy tool steel article having a unique combination of hardness and toughness, said article being made from consolidated alloy powder having the following weight percent composition:

| | wt. % |
|---|---|
| C | 1.90–2.20 |
| Mn | 0.15–0.90 |
| Si | 0.50–0.80 |
| P | 0.030 max. |
| S | 0–0.30 |
| Cr | 4.0–5.0 |
| Ni + Cu | 0.50 max. |
| Mo | 1.0 max. |
| Co | 7–11 |
| W | 12.25–13.5 |
| V | 5.0–7.0 |

and the balance essentially iron and usual impurities, wherein the elements C, Cr, Mo, W, and V are balanced such that $$-0.10 \leqq \Delta C \leqq 0.35$$

where $$\Delta C = ((0.033W) + (0.063Mo) + (0.06Cr) + (0.2V)) - C$$

said article, when heat treated, provides a Rockwell C hardness of at least about 69.5.

24. A tool steel article as set forth in claim 23 wherein the alloy powder contains about 4.25–5.00% chromium.

25. A tool steel article as set forth in claim 23 wherein the alloy powder contains about 7.5–10.5% cobalt.

26. A tool steel article as set forth in claim 23 wherein the alloy powder contains about 12.5–13.5% tungsten.

27. A tool steel article as set forth in claim 23 wherein the alloy powder contains about 5.0–6.5% vanadium.

28. A tool steel article as set forth in claim 23 wherein the alloy powder contains not more than about 0.06% sulfur.

29. A powder metallurgy tool steel article having a unique combination of hardness and toughness made from consolidated alloy powder having the following weight percent composition:

| | wt. % |
|---|---|
| C | 1.90–2.20 |
| Mn | 0.15–0.90 |
| Si | 0.55–0.75 |
| P | 0.030 max. |
| S | 0–0.30 |
| Cr | 4.25–5.00 |
| Ni + Cu | 0.50 max. |
| Mo | 1.0 max. |
| Co | 7.5–10.5 |
| W | 12.5–13.5 |
| V | 5.0–6.5 |

and the balance essentially iron and usual impurities, wherein the elements C, Cr, Mo, W, and V are balanced such that $$-0.15 \leqq \Delta C \leqq -0.25$$

where $$\Delta C = ((0.033W) + (0.063Mo) + (0.06Cr) + (0.2V)) - C$$

said article, when heat treated, provides a Rockwell C hardness of at least about 69.5.

30. A tool steel article as set forth in claim 29 wherein the alloy powder contains not more than about 0.06% sulfur.

* * * * *

UNITED STATES PATENT AND TRADEMARK OFFICE

CERTIFICATE OF CORRECTION

PATENT NO. : 6,482,354 B1 
DATED : November 19, 2002
INVENTOR(S) : David E. Wert, Gregory J. Del Corso and Harrison A. Garner, Jr.

It is certified that error appears in the above-identified patent and that said Letters Patent is hereby corrected as shown below:

Title page,
Item [57], ABSTRACT,
Line 8, "$-0.05 \leq \Delta C \leq -0.42$" should read -- $-0.05 \geq \Delta C \geq -0.42$ --.

Column 9,
Line 46, "$-0.05 \leq \Delta C \leq -0.42$" should read -- $-0.05 \geq \Delta C \geq -0.42$ --.

Column 10,
Line 19, "$-0.10 \leq \Delta C \leq -0.35$" should read -- $-0.10 \geq \Delta C \geq -0.35$ --.
Lines 32 and 56, "$-0.15 \leq \Delta C \leq -0.25$" should read -- $-0.15 \geq \Delta C \geq -0.25$ --.

Column 11,
Line 20, "$-0.05 \leq \Delta C \leq -0.42$" should read -- $-0.05 \geq \Delta C \geq -0.42$ --.

Column 12,
Line 5, "$-0.10 \leq \Delta C \leq -0.35$" should read -- $-0.10 \geq \Delta C \geq -0.35$ --.
Line 46, "$-0.15 \leq \Delta C \leq -0.25$" should read -- $-0.15 \geq \Delta C \geq -0.25$ --.

Signed and Sealed this

Thirtieth Day of March, 2004

JON W. DUDAS
*Acting Director of the United States Patent and Trademark Office*